US010485368B2

(12) United States Patent
Olds et al.

(10) Patent No.: US 10,485,368 B2
(45) Date of Patent: Nov. 26, 2019

(54) VISUALLY-DISTINGUISHABLE PANELED SKIRT

(71) Applicants: Evie Olds, Conroe, TX (US); John Earl Olds, Conroe, TX (US)

(72) Inventors: Evie Olds, Conroe, TX (US); John Earl Olds, Conroe, TX (US)

( * ) Notice: Subject to any disclaimer, the term of this patent is extended or adjusted under 35 U.S.C. 154(b) by 354 days.

(21) Appl. No.: 15/495,766

(22) Filed: Apr. 24, 2017

(65) Prior Publication Data

US 2018/0078071 A1 Mar. 22, 2018

Related U.S. Application Data

(60) Provisional application No. 62/397,230, filed on Sep. 20, 2016.

(51) Int. Cl.
*B32B 3/10* (2006.01)
*A47G 33/04* (2006.01)

(52) U.S. Cl.
CPC ..... *A47G 33/045* (2013.01)

(58) Field of Classification Search
None
See application file for complete search history.

(56) References Cited

U.S. PATENT DOCUMENTS 8,166,893 B2 * 5/2012 Davis ..... A47B 13/16 108/26
2007/0020428 A1 * 1/2007 Hernandez ..... A47G 11/006 428/66.6

* cited by examiner

*Primary Examiner* — Christopher M Polley

(57) ABSTRACT

A visually-distinguishable paneled skirt is an apparatus that conceals undesirable objects, items, or surfaces such as a Christmas tree stand. The apparatus includes a plurality of panels and a plurality of fasteners. Each of the plurality of panels is connected to one another by the plurality of fasteners. This allows the user to interchange the plurality of panels as to best represent the current members of his or her family. Each of the plurality of panels is arranged with one another into an annular configuration. An opening allows the trunk of a Christmas tree to traverse through the apparatus. The apparatus may be converted into a tablecloth with a covering panel, which covers the opening. The circumference of the apparatus may be extended with an annular panel.

9 Claims, 5 Drawing Sheets

VISUALLY-DISTINGUISHABLE PANELED SKIRT

The current application claims priority to U.S. provisional application Ser. No. 62/397,230 filed on Sep. 20, 2016.

FIELD OF THE INVENTION

The present invention generally relates to a skirt that conceals undesirable objects or items. More specifically, the present invention is a visually-distinguishable paneled skirt that allows a user to distinguish the paneled skirt by interchanging the panels according to the user's preferences.

BACKGROUND OF THE INVENTION

Traditional skirts include a single piece of material with a slit to be placed around a Christmas tree or the like. Typically, a traditional skirt is only used to cover items a user does not wish for others to see. Each skirt presents a variety of designs, however each skirt is limited to a single design or theme The present invention allows a user to vary and customize a skirt. The present invention may be converted from a skirt into table cloth. The present invention preferably represents the heritage of a family. As the dynamics of a family change, so does the present invention. The present invention includes a plurality of panels that represent each member of the family. If a son or daughter has a family of their own in the future has a family of their own in the future, a panel may be used to represent this new family unit. The original panel of this son or daughter may be integrated into his or her own skirt along with the members of his or her own family. The present invention may further present a family crest, a quote, or any other representation as a family overall with an annular panel.

DETAILED DESCRIPTION OF THE INVENTION

All illustrations of the drawings are for the purpose of describing selected versions of the present invention and are not intended to limit the scope of the present invention.

Figure 2:
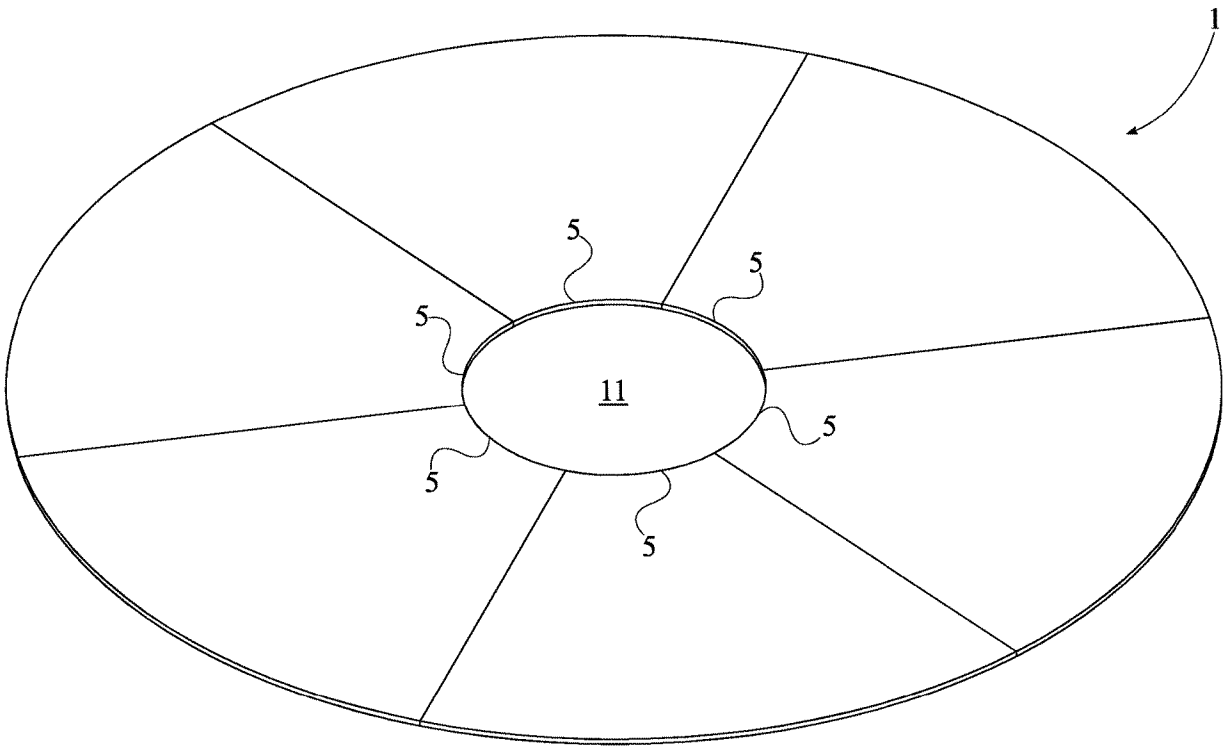
FIG. 2 is a perspective view of the present invention, wherein the plurality of panels is arranged in an annular configuration.
Figure 4:
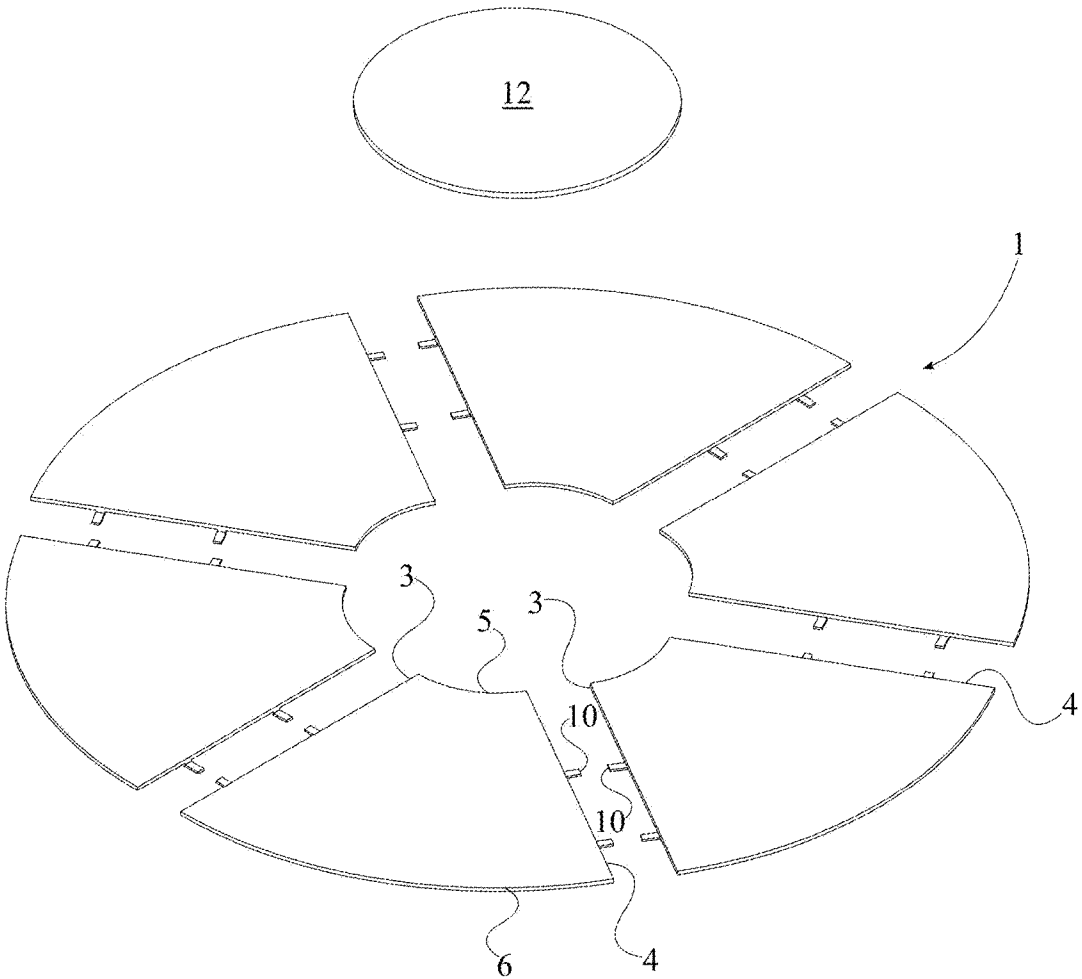
FIG. 4 is an exploded view of the present invention with a covering panel.
Figure 5:
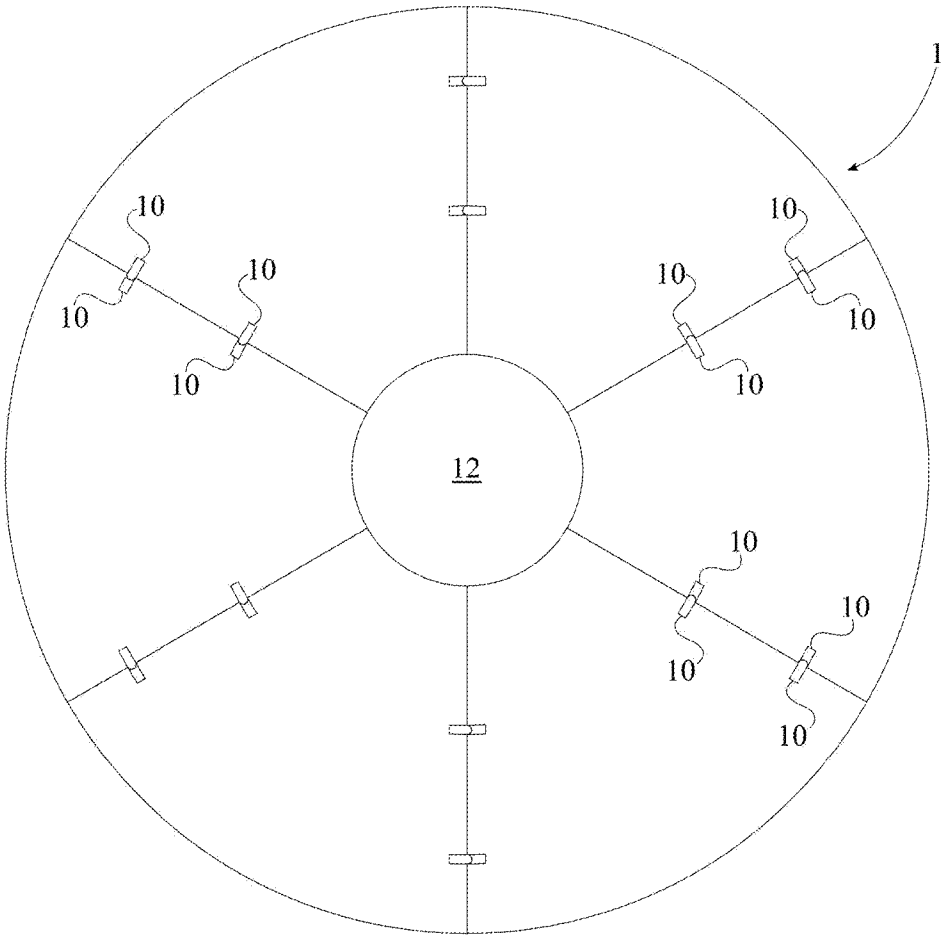
FIG. 5 is a bottom view of the present invention a plurality of fasteners and the covering panel.

The present invention is a visually-distinguishable paneled skirt that allows a user to customize a skirt that best represents his or her family heritage. The present invention allows a user to interchange portions of the skirt to represent current and new family members. More specifically, the present invention comprises a plurality of panels 1 and a plurality of fasteners 10, as shown in FIG. 2, FIG. 4, and FIG. 5. The plurality of panels 1 allows each skirt to be distinguishable from one another. Each of the plurality of panels 1 preferably represents a member of the user's family. The user may interchange the panel of a son or daughter with another panel that represents a new family of the son or daughter. The son or daughter may have gotten married and had children thereby creating a new family. The son or daughter may retrieve the panel that represents himself or herself in order to assemble his or her own skirt with the new member of the new family. The plurality of fasteners 10 connects the plurality of panels 1 to one another and prevents the unwanted separation of the plurality of panels 1, as illustrated in the bottom view of FIG. 5. The plurality of fasteners 10 may be, but is not limited to, buttons, snap buttons, zippers, hook and loop fasteners, ties. In the illustrations of the present invention, hook and loop fasteners are illustrated as the hook and loop fasteners are concealable beneath the plurality of panels 1. Each of the plurality of panels 1 comprises a panel body 2, a first lateral edge 3, a second lateral edge 4, a concave edge 5, and a convex edge 6. The panel body 2 serves to cover an item or surface the user wishes to conceal. The first lateral edge 3 and the second lateral edge 4 allows each panel body 2 to align between two other panel bodies 2 and define the overall shape of the present invention. The concave edge 5 allows a vertical item or object to traverse through the present invention. For example, the vertical item or object is a Christmas tree trunk. The convex edge 6 defines the overall circular arrangement of the present invention around or about an item or surface.

Figure 1:
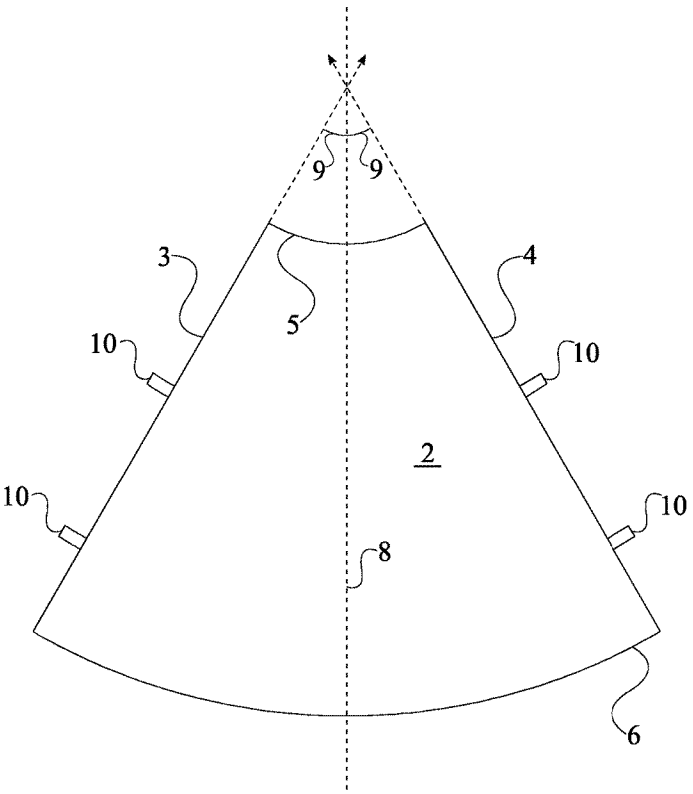
FIG. 1 is a top view of a single panel of the plurality of panels of the present invention.

The overall configuration of the aforementioned components allows the present invention to cover and conceal a variety of items and objects, such as a Christmas tree stand. The first lateral edge 3 and the second lateral edge 4 are positioned opposite to each other across the panel body 2, as shown in FIG. 1. Similarly, the concave edge 5 and the convex edge 6 are positioned opposite each other across the panel body 2, also shown in FIG. 1. This arrangement allows the plurality of panels 1 to attach to one another and effectively cover a Christmas tree stand. Each of the plurality of panels 1 are radially positioned about the central skirt axis 7 so as to best accommodate the circular structure of the Christmas tree stand. The first lateral edge 3 of each of the plurality of panels 1 is detachably attached along the second lateral edge 4 of an adjacent panel from the plurality of panels 1 by the plurality of fasteners 10 so that the user may interchange the plurality of panels 1 without compromising the integrity of the structure of the skirt as a whole.

In the preferred embodiment of the present invention, the first lateral edge 3 and the second lateral edge 4 are straight edges. A radial altitude 8 of the panel body 2 traverses along the panel body 2 in between the first lateral edge 3 and the second lateral edge 4, as illustrated in FIG. 1. The first lateral edge 3 is oriented at a specified acute angle 9 with the radial altitude 8, and the second lateral edge 4 is oriented at a specified acute angle 9 with the radial altitude 8. This configuration allows the present invention to taper from the convex edges 6 of the plurality of panels 1 to the concave edges 5 of the plurality of panels 1. More specifically, the concave edge 5 and the convex edge 6 are concentrically positioned with each other so that the overall shape of the present invention is annular. More specifically, the plurality of panels 1 is arranged into an annular configuration as to mirror the structure of traditional Christmas tree skirts.

An opening 11 allows the tree trunk of a Christmas tree to traverse through the skirt without compromising the integrity of the present invention as defined by the plurality of panels 1. The opening 11 is delineated by the concave edge 5 of each of the plurality of panels 1, as shown in FIG. 2. The present invention is preferably circular so that most, if not all, of the Christmas tree stand is visible. In an alternate embodiment of the present invention, a covering panel 12 is used to cover up the opening 11 so that the present invention can function as a table cover. The covering panel 12 is positioned onto the opening 11 so that the present invention covers the entire area beneath the present invention, as shown in the bottom view of FIG. 5. The covering panel 12 is also detachably attached to the plurality of panels 1, shown in FIG. 4, so that the present invention is effectively converted into a table cloth. The covering panel 12 is preferably connected to each of the plurality of panels 1 with the same kind of fasteners that connect the plurality of panels 1 to each other.

Figure 3:
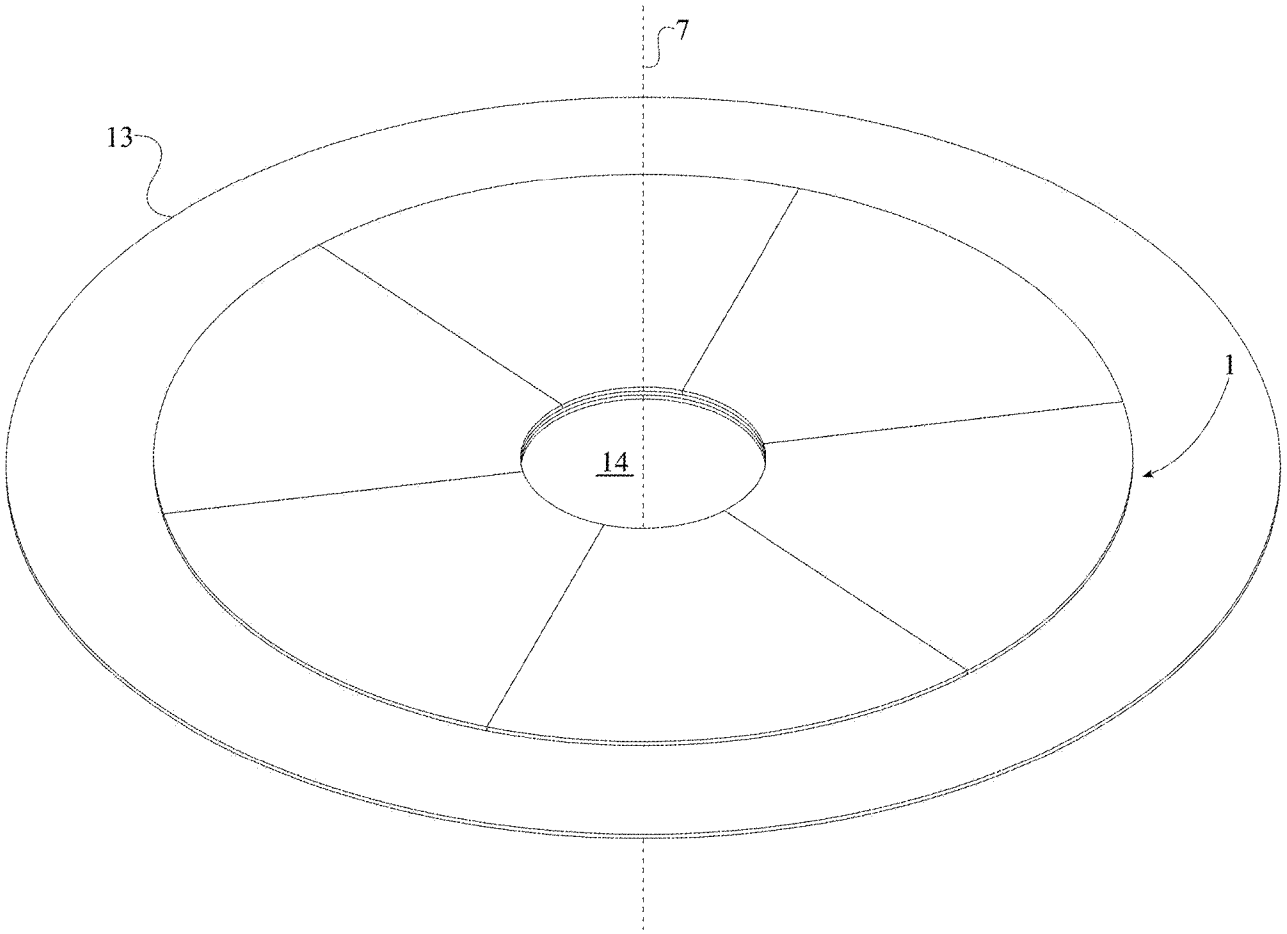
FIG. 3 is a perspective view of the plurality of panels with an annular panel, wherein the plurality of panels is superimposed onto the annular panel.

In another embodiment of the present invention, an annular panel 13 allows the user to extend the circumference of the skirt and further customize the distinguishability of the skirt. The annular panel 13 comprises a perimeter that is preferably larger than the circumference of the present invention as defined by the plurality of panels 1, as shown in FIG. 3. The annular skirt may visually present a quote, a crest, or a variety of other representations of the user's family. The plurality of panels 1 is superimposed onto the annular panel 13 so that the plurality of panels 1 and the annular panel 13 define a continuous skirt. Furthermore, a central hole 14 of the annular panel 13 is concentrically positioned with the convex edge 6 for each of the plurality of panels 1 so that the trunk of a Christmas tree may freely traverse through both the annular panel 13 and the plurality of panels 1. In an alternate embodiment of the present invention, the plurality of panels 1 may be secured onto the annular panel 13 so as to fix the orientation of the annular panel 13 about the plurality of panels 1. The same kind of fasteners that connect each of the plurality of panels 1 to each other may also attach the each of the plurality of panels 1 to the annular panel 13. This allows for an easier removal and installation of a panel amongst the connects plurality of panels 1. In addition to this embodiment of the present invention, the covering panel 12 may conceal the opening 11 of the plurality of panels 1 and consequently the annular panel 13, thereby converting the skirt into a table cloth.

Although the invention has been explained in relation to its preferred embodiment, it is to be understood that many other possible modifications and variations can be made without departing from the spirit and scope of the invention as hereinafter claimed.

What is claimed is:

1. A visually-distinguishable paneled skirt comprising:
a plurality of panels;
a plurality of fasteners;
an annular panel;
each of the plurality of panels comprising a panel body, a first lateral edge, a second lateral edge, a concave edge and a convex edge, the plurality of fasteners being discretely distributed only along a middle section of each of the first lateral edge and the second lateral edge;
the first lateral edge and the second lateral edge being positioned opposite to each other across the panel body;
the concave edge and the convex edge being positioned opposite to each other across the panel body;
the plurality of panels being radially positioned about a central skirt axis;
the first lateral edge of each of the plurality of panels being detachably attached along the second lateral edge of an adjacent panel from the plurality of panels by the plurality of fasteners;
the plurality of panels being superimposed onto the annular panel;
a central hole of the annular panel being concentrically positioned with the convex edge for each of the plurality of panels;
the first lateral edge and the second lateral edge being straight edges;
a radial altitude of the panel body traversing along the panel body in between the first lateral edge and the second lateral edge;
the first lateral edge being oriented at a first specified acute angle with the radial altitude;
the second lateral edge being oriented at a second specified acute angle with the radial altitude; and
the first specified acute angle and the second specified acute angle jointly forming an acute angle.

2. The visually-distinguishable paneled skirt as claimed in claim 1 comprising:
the concave edge and the convex edge are concentrically positioned with each other; and
the plurality of panels being arranged into an annular configuration.

3. The visually-distinguishable paneled skirt as claimed in claim 1 comprising:
an opening; and
the opening being delineated by the concave edge of each of the plurality of panels.

4. The visually-distinguishable paneled skirt as claimed in claim 3 comprising:
a covering panel;
the covering panel being positioned onto the opening; and
the covering panel being detachably attached to the plurality of panels.

5. A visually-distinguishable paneled skirt comprising:
a plurality of panels;
a plurality of fasteners;
an opening;
an annular panel;
each of the plurality of panels comprising a panel body, a first lateral edge, a second lateral edge, a concave edge and a convex edge, the plurality of fasteners being discretely distributed only along a middle section of each of the first lateral edge and the second lateral edge;
the first lateral edge and the second lateral edge being positioned opposite to each other across the panel body;
the concave edge and the convex edge being positioned opposite to each other across the panel body;
the plurality of panels being radially positioned about a central skirt axis;
the first lateral edge of each of the plurality of panels being detachably attached along the second lateral edge of an adjacent panel from the plurality of panels by the plurality of fasteners;
the opening being delineated by the concave edge of each of the plurality of panels;
the plurality of panels being superimposed onto the annular panel;
a central hole of the annular panel being concentrically positioned with the convex edge for each of the plurality of panels;
the first lateral edge and the second lateral edge being straight edges;
a radial altitude of the panel body traversing along the panel body in between the first lateral edge and the second lateral edge;
the first lateral edge being oriented at a first specified acute angle with the radial altitude;

the second lateral edge being oriented at a second specified acute angle with the radial altitude; and the first specified acute angle and the second specified acute angle jointly forming an acute angle.

6. The visually-distinguishable paneled skirt as claimed in claim 5 comprising:

the concave edge and the convex edge are concentrically positioned with each other; and the plurality of panels being arranged into an annular configuration.

7. The visually-distinguishable paneled skirt as claimed in claim 5 comprising:

a covering panel;

the covering panel being positioned onto the opening; and the covering panel being detachably attached to the plurality of panels.

8. A visually-distinguishable paneled skirt comprising:

a plurality of panels;

a plurality of fasteners;

an opening;

an annular panel;

a covering panel;

each of the plurality of panels comprising a panel body, a first lateral edge, a second lateral edge, a concave edge and a convex edge, the plurality of fasteners being discretely distributed only along a middle section of each of the first lateral edge and the second lateral edge;

the first lateral edge and the second lateral edge being positioned opposite to each other across the panel body;

the concave edge and the convex edge being positioned opposite to each other across the panel body;

the plurality of panels being radially positioned about a central skirt axis;

the first lateral edge of each of the plurality of panels being detachably attached along the second lateral edge of an adjacent panel from the plurality of panels by the plurality of fasteners;

the opening being delineated by the concave edge of each of the plurality of panels;

the plurality of panels being superimposed onto the annular panel;

a central hole of the annular panel being concentrically positioned with the convex edge for each of the plurality of panels;

the covering panel being positioned onto the opening;

the covering panel being detachably attached to the plurality of panels;

the first lateral edge and the second lateral edge being straight edges;

a radial altitude of the panel body traversing along the panel body in between the first lateral edge and the second lateral edge;

the first lateral edge being oriented at a first specified acute angle with the radial altitude;

the second lateral edge being oriented at a second specified acute angle with the radial altitude; and the first specified acute angle and the second specified acute angle jointly forming an acute angle.

9. The visually-distinguishable paneled skirt as claimed in claim 8 comprising:

the concave edge and the convex edge are concentrically positioned with each other; and the plurality of panels being arranged into an annular configuration.

* * * * *